United States Patent [19]

Nortenius

[11] Patent Number: 4,470,248

[45] Date of Patent: Sep. 11, 1984

[54] ARRANGEMENT FOR WINDING YARN, STRIP-MATERIAL OR THE LIKE FROM A SUPPLY ROLL ONTO A BUNCH OF WIRES OR THE LIKE FED THROUGH THE CENTER HOLE OF THE SUPPLY ROLL

[75] Inventor: Bengt A. Nortenius, Nyponvägen, Sweden

[73] Assignee: Telefonaktiebolaget L M Ericsson, Stockholm, Sweden

[21] Appl. No.: 448,985

[22] PCT Filed: Mar. 16, 1982

[86] PCT No.: PCT/SE82/00072

§ 371 Date: Nov. 23, 1982

§ 102(e) Date: Nov. 23, 1982

[87] PCT Pub. No.: WO82/03375

PCT Pub. Date: Oct. 14, 1982

[30] Foreign Application Priority Data

Mar. 25, 1981 [SE] Sweden ..... 8101920

[51] Int. Cl.[3] ..... B65H 81/08

[52] U.S. Cl. ..... 57/18; 57/6; 57/17; 57/19; 57/22; 57/261

[58] Field of Search ..... 57/16–19, 57/3, 6, 10, 11, 261, 22

[56] References Cited

U.S. PATENT DOCUMENTS

| | | | |
|---|---|---|---|
| 2,118,136 | 5/1938 | Bardsley | 57/18 |
| 3,879,924 | 4/1975 | Dahmen | 57/18 X |
| 4,117,654 | 10/1978 | Petrov | 57/19 |
| 4,135,353 | 1/1979 | Eisenberg | 57/22 |
| 4,143,506 | 3/1979 | Pierce et al. | 57/22 |
| 4,170,101 | 10/1979 | Bock | 57/18 X |
| 4,170,864 | 10/1979 | Beyerl et al. | 57/19 X |
| 4,322,941 | 4/1982 | Sarracino | 57/17 X |

*Primary Examiner*—John Petrakes

*Attorney, Agent, or Firm*—Roberts, Spiecens & Cohen

[57] ABSTRACT

An arrangement for winding yarn (3) from a supply roll (2) by means of a flyer (4) onto a bunch of wires fed through the center hole of the supply roll for automatically transferring to the unwinding of a new supply roll (2') when the yarn on the first supply roll (2) is used up or broken. The new supply roll (2') is disposed downstream of the first supply roll (2) seen in the direction of feed of the bunch of wires and a second flyer (4') is associated with it. Downstream of the new supply roll (2') and the second flyer (4') there is a holding device (13) to loosely hold the free end of the yarn (3') on the new supply roll (2') as long as the yarn (3) on the old supply roll (2) is not used up or broken. At its free end the yarn (3') on the new supply roll (2') is formed into a sliding knot (15) carried by the holding device (13), through which sliding knot the bunch of wires (1) is freely fed. To rotate the second flyer (4) when the yarn (3) on the first supply roll (2) is either used up or broken, there is a drive unit and control device (6', 7', 8', 9', 10). The holding device (13) is furthermore adapted to release the sliding knot (15) and to have it tightened around the bunch of wires (1) when the second flyer (4') starts to rotate and thereafter to release the free end (18) of the new yarn (3') as a consequence of the continued feeding of the bunch of wires (1).

2 Claims, 1 Drawing Figure

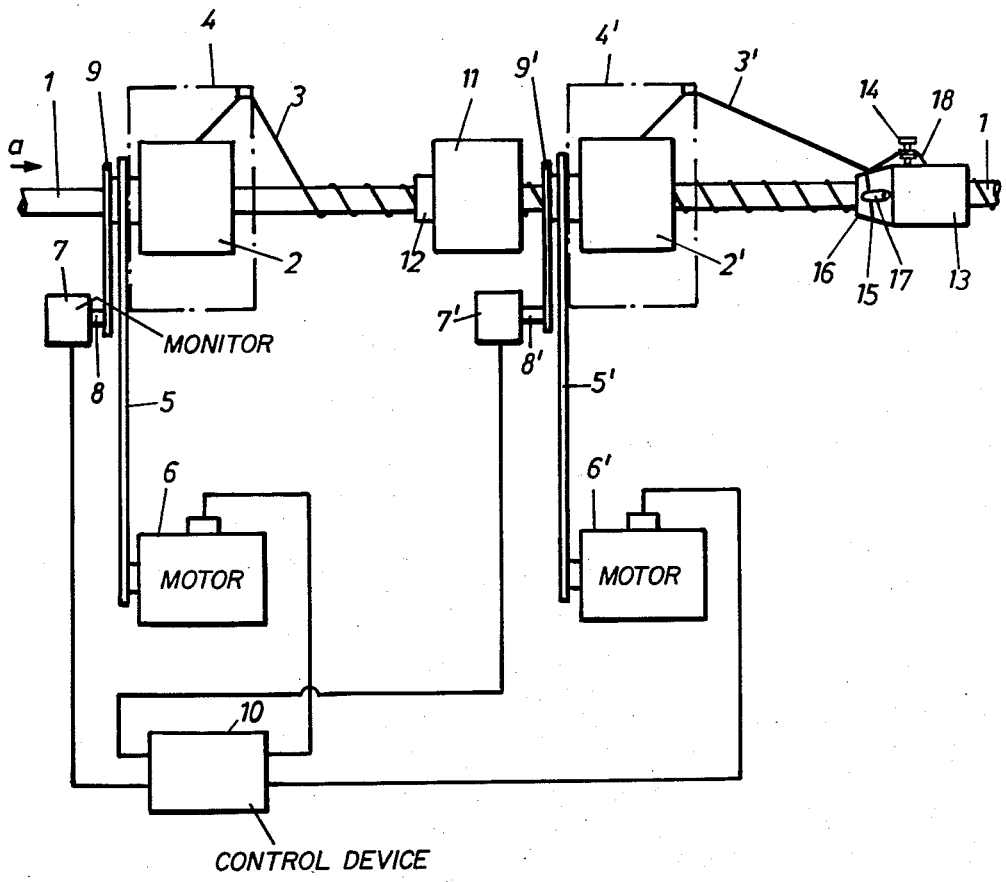
a
1
9
4
3
2
7
8
MONITOR
5
6
MOTOR
10
CONTROL DEVICE
11
12
9'
4'
3'
2'
7'
8'
5'
6'
MOTOR
14
18
1
16
15
17
13

ARRANGEMENT FOR WINDING YARN, STRIP-MATERIAL OR THE LIKE FROM A SUPPLY ROLL ONTO A BUNCH OF WIRES OR THE LIKE FED THROUGH THE CENTER HOLE OF THE SUPPLY ROLL

FIELD OF THE INVENTION

The present invention relates to an arrangement for winding yarn, strip-material or the like from a supply roll onto a bunch of wires or the like fed through the center hole of a supply roll by means of a flyer rotating around the bunch of wires for automatically starting winding the yarn, strip-material or the like from a new supply roll, when the yarn, the strip-material or the like on the first supply roll is either used up or broken, the new supply roll also being disposed in such a manner that the bunch of wires is fed through the center hole of the new supply roll.

BACKGROUND

To keep a bunch of wires together it is known within the cable art to helically apply either yarn or strip-material around the bunch of wires. For this purpose most often a so called flyer is used having a roll placed around the bunch of wires. The yarn is fastened through the flyer onto the bunch of wires and while the bunch of wires is pulled forward the flyer starts to rotate, whereby the yarn will be wound helically around the bunch of wires with a pitch determined by the rotary speed of the flyer and the linear feeding speed of the bunch of wires.

When the yarn is used up on the roll the forward feeding of the bunch of wires as well as the rotation of the flyer are stopped. This is most often done automatically. Then, the empty roll is removed from the flyer by an operator whereupon a new roll of yarn through which the bunch of wires has been threaded in advance, is placed in the flyer. After that, the free end of the yarn on the new roll is connected with the end of the yarn from the old roll, whereupon the feeding of the bunch of wires can start again and the flyer starts to rotate.

Also in those cases when the yarn for some reason breaks, the feeding of the bunch of wires is stopped as well as the rotation of the flyer and the operator has to perform a splicing operation before the bunch of wires is fed forward again and the flyer starts to rotate.

SUMMARY OF THE INVENTION

An object of the present invention is to provide an arrangement that makes it possible to automatically start unwinding the new supply roll when the material on the old supply roll is either used up or broken.

By this arrangement, it would be possible to increase the output considerably due to the fact that the installation could be left unmanned for example at night.

This is achieved in that the arrangement mentioned by way of introduction has obtained the characterizing features indicated in the claims.

BRIEF DESCRIPTION OF THE DRAWING

The invention will be described in greater detail below with reference to the accompanying drawing, the single FIGURE of which shows an embodiment of the arrangement according to the invention.

PREFERRED EMBODIMENT

The FIGURE shows an installation for winding yarn onto an assembly or bunch of wires 1 fed forwardly with a predetermined speed, which installation in a manner known per se comprises a roll of yarn 2, through the center hole of which the bunch of wires 1 is fed forwardly and which, in a manner not shown, is journalled to rotate around the bunch of wires. To apply the yarn 3 from the roll 2 onto the bunch of wires 1 there is a so called yarn flyer 4, indicated by means of dashed and dotted lines and which through a driving belt 5 can be caused to rotate around the bunch of wires 1 and the yarn roll 2 by means of a driving motor 6. The yarn roll 2 will rotate due to the fact that the yarn 3 is unwound from the roll by means of the flyer 4. To obtain a uniform unwinding of the yarn 3 from the roll 2 it is necessary, however, to slow the roll down in a manner not shown. When the yarn on the roll 2 is used up or broken, i.e. when the roll 2 stops rotating, this will be sensed by means of a monitor 7 which in the shown embodiment has an axle 8, driven by a belt 9 placed around a pulley (not shown), which in turn is fixed to the rotation axis of the yarn roll 2. The monitor 7, for example, can be adapted to emit pulses, the pulse repetition frequency of which corresponds to the rotary speed of the roll 2, to a control device 10. Thus, when the yarn on the roll 2 is used up or broken, i.e. the rotary speed of the roll 2 decreases, this is detected by the control device 10, which then stops the driving motor 6 whereby the flyer 4 is stopped as well. In those cases when the yarn is broken, the operator performs a splicing operation. If, on the other hand, the yarn on the roll 2 is used up, the operator removes the empty roll and places a new roll of yarn 11 inside the flyer 4 and ties the free end of the new roll 11 together with the end of the yarn from the old roll. Before the winding operation has started, the new roll 11 has been placed, in a manner not shown, on a tubular element 12 through the center hole of which the bunch of wires 1 is fed.

The equipment described up to now is conventional in a yarn winding installation.

In order to facilitate an automatic transfer to a new yarn roll without the assistance of an operator, it is suggested according to the invention that the installation described above be completed with at least one substantially identical installation located downstream of the first installation, in the direction of feed of the bunch of wires 1, indicated by arrow a. The different elements in the completed installation, which elements are identical with the elements in the installation described above comprise a yarn roll 2', a flyer 4' indicated by means of dashed and dotted lines, which flyer is driven by a driving belt 5' by means of a driving motor 6' and a monitor 7' the axle 8' of which is driven by a belt 9' placed around a pulley (not shown) which in turn is connected to the rotation axis of the yarn roll 2'. The monitor 7' as well as the rotation axis of the yarn roll 2' are driven by motor 6'. The monitor 7' as well as the monitor 7 are connected to the control device 10 to control the driving motor 6'.

According to the invention, a holding device 13 is associated with the yarn roll 2' and the flyer 4'. The holding device 13 is tubular and through its center hole the bunch of wires 1 is fed. The holding device 13 is provided downstream of the yarn roll 2' and the flyer 4' in the direction of feeding of the bunch of wires 1. The holding device 13 comprises a first clamping means 14 for holding the free end of the yarn 3' on the roll 2'. The clamping means 14 in the embodiment shown is made up of .wo spring-biassed clamping plates which can be clamped together by means of a screw. At its free end, the yarn 3' on the roll 2' is formed into a sliding knot 15 which is carried by a tapered part 16 of the holding device 13, facing the roll 2' and through which the bunch of wires is freely fed. To keep the sliding knot 15 on the tapered part 16 there are other clamping means 17, which in the embodiment shown, consist of two plate springs only one of which is shown in the FIGURE, as the other is located on the opposite side of the tapered part 16.

During normal operation i.e. as long as the yarn on the roll 2 is not used up or broken, the flyer 4' does not rotate and consequently the sliding knot 15 is maintained in the position shown in the FIGURE. However, when the yarn on the roll 2 is used up or breaks, the control device 10 is adapted to automatically initiate the following procedure without the need of an operator:

The fact that the yarn 3 on the roll 2 is used up or broken is detected by the control device 10 in that the axle of the monitor 7 stops rotating as a consequence of the fact that the roll 2 stops rotating. Then, the control device 10 disconnects the driving motor 6 for the flyer 4 and connects the driving motor 6' for the flyer 4'. Then, the flyer 4' starts to rotate and unwind the yarn 3' from the roll 2'. The plate springs 17 are adapted to hold the sliding knot 15 so tight that it is not pulled down onto the bunch of wires 1 until the flyer 4' starts to rotate. The sliding knot 15 is then tightened around the bunch of wires 1 as a consequence of the continued rotation of the flyer 4' and the yarn 3' is helically wound around the bunch of wires 1 as a consequence of its continued feeding in the direction a. When the sliding knot 15 is fed into the center hole of the holding device 13, the free end of the yarn 3' is released from the clamping means 14, whereupon the winding of the yarn around the bunch of wires 1 completely has been taken over by the flyer 4'. The end of the yarn 3 will, thus, be wound between the bunch of wires 1 and the yarn 3' from the new roll 2'.

By means of the equipment just described, a transfer to a new yarn roll can be made automatically as soon as the yarn on the original roll is used up or broken. In this manner the production can continue without the need of an operator to change rolls or to crry out a splicing operation.

It is obvious that the installation, as necessary, can be completed with more than one installation. These installations, in turn, must then be arranged downstream of each other seen in the direction of feeding of the bunch of wires 1.

What we claim is:

1. In an arrangement for winding yarn, strip-material or the like from a supply roll onto an assembly of wires fed through a center hole of the supply roll by means of a flyer rotating around the wires and the supply roll for automatically starting winding of the yarn, the strip-material or the like from a new supply roll when the yarn, the strip-material or the like on the first supply roll is either used up or broken, the new supply roll being disposed so that the assembly of wires is fed through the center hole of the new supply roll, the improvement wherein the new supply roll is disposed downstream of the first supply roll in the direction of feed of the assembly of wires, a second flyer being associated with said new supply roll, said second flyer being rotatable around the assembly of wires for winding the yarn, the strip-material or the like from the new supply roll onto the assembly of wires, a holding means also associated with said new supply roll, said holding means being disposed downstream of the new supply roll and the second flyer to loosely and releasably hold a free end of the new yarn, strip-material or the like which at said free end is formed into a sliding knot through which the assembly of wires is freely fed, and means for rotating the second flyer when the yarn, the strip-material or the like on the first supply roll is either used up or broken, said sliding knot being tightened around the assembly of wires when the second flyer starts to rotate and the holding means releases the free end of the new yarn, strip-material or the like as a consequence of the continued feeding of the assembly of wires.

2. In an arrangement according to claim 1 wherein said holding means comprises a first clamping means for holding the sliding knot and a second clamping means for holding the free end of the new yarn, strip-material or the like.

* * * * *